US011542797B1

(12) United States Patent
Zahran et al.

(10) Patent No.: US 11,542,797 B1
(45) Date of Patent: Jan. 3, 2023

(54) TAPERED MULTISTAGE PLUNGER LIFT WITH BYPASS SLEEVE

(71) Applicants: Saudi Arabian Oil Company, Dhahran (SA); Clint Mason, Carstairs (CA)

(72) Inventors: Amr Mohamed Zahran, Al Khobar (SA); Syed Muhammad Bin Syed Taha, Dhahran (SA); Mohammed Ahmed Alsayed, Dammam (SA); Mohannad Yousef Almahfouz, Dhahran (SA); Clint Mason, Alberta (CA)

(73) Assignees: Saudi Arabian Oil Company, Dhahran (SA); Clint Mason, Carstairs (CA)

( * ) Notice: Subject to any disclaimer, the term of this patent is extended or adjusted under 35 U.S.C. 154(b) by 0 days.

(21) Appl. No.: 17/474,230

(22) Filed: Sep. 14, 2021

(51) Int. Cl.

| | |
|---|---|
| ***E21B 43/12*** | (2006.01) |
| ***E21B 34/06*** | (2006.01) |
| ***E21B 33/10*** | (2006.01) |
| ***F04B 47/12*** | (2006.01) |
| ***E21B 33/068*** | (2006.01) |

(52) U.S. Cl.
CPC ..... *E21B 43/121* (2013.01); *E21B 33/10* (2013.01); *E21B 34/06* (2013.01); *F04B 47/12* (2013.01); *E21B 33/068* (2013.01)

(58) Field of Classification Search
CPC .... E21B 43/121; E21B 43/122; E21B 43/123; E21B 43/12; E21B 43/13; E21B 33/068; E21B 34/06; F04B 47/12
See application file for complete search history.

(56) References Cited

U.S. PATENT DOCUMENTS 2,038,426 A 4/1936 Fletcher
2,577,210 A 12/1951 Walter
(Continued)

FOREIGN PATENT DOCUMENTS

CA 2164145 11/1996
CN 2336113 9/1999
(Continued)

OTHER PUBLICATIONS

Apergy Unlocking Energy, "PCS Multi-Stage Plunger Lift Equipment Catalog, Plunger Lift: Multi-Stage Plunger Tools," Oct. 2018, 2 pages.
(Continued)

*Primary Examiner* — George S Gray
(74) *Attorney, Agent, or Firm* — Fish & Richardson P.C.

(57) ABSTRACT

A multistage plunger lift system includes an upper production tubing segment positioned in a wellbore uphole of a lower production tubing segment, with the upper segment having a greater diameter than the lower segment. A lower travelling plunger and an upper traveling plunger are sized and configured to fit and travel within the lower segment and the upper segment, respectively. A plunger lift tool is positioned in the upper segment between the upper plunger and the lower plunger, and includes within its main body a fluid passageway with a one-way valve. A plunger receptacle sleeve at the bottom end of the lift tool receives the lower plunger and includes one or more vents configured to allow fluids to flow around the lower plunger when the lower plunger is received within the plunger receptacle sleeve.

23 Claims, 4 Drawing Sheets

(56) References Cited

U.S. PATENT DOCUMENTS

| | | | | |
|---|---|---|---|---|
| 2,676,547 | A * | 4/1954 | Knox | F04B 47/12 417/246 |
| 2,762,308 | A | 9/1956 | Tomlinson | |
| 3,150,596 | A | 9/1964 | Knox | |
| 3,735,815 | A | 5/1973 | Myers | |
| 3,749,119 | A | 7/1973 | Tausch et al. | |
| 4,009,753 | A | 3/1977 | McGill et al. | |
| 4,043,392 | A | 8/1977 | Gazda | |
| 4,211,279 | A | 7/1980 | Isaacks | |
| 4,366,861 | A | 1/1983 | Milam | |
| 4,531,228 | A | 7/1985 | Kazunori et al. | |
| 4,596,516 | A | 6/1986 | Scott et al. | |
| 4,723,606 | A | 2/1988 | Vinzant | |
| 4,813,481 | A | 3/1989 | Sproul et al. | |
| 4,846,281 | A | 7/1989 | Clary | |
| 5,211,242 | A | 5/1993 | Coleman et al. | |
| 5,263,683 | A | 11/1993 | Wong | |
| 5,271,725 | A | 12/1993 | Freet et al. | |
| 5,389,128 | A | 2/1995 | Lopes | |
| 5,431,228 | A | 7/1995 | Weingarten | |
| 5,472,054 | A | 12/1995 | Hinds et al. | |
| 5,516,360 | A | 5/1996 | Normandeau et al. | |
| 5,653,286 | A | 8/1997 | McCoy et al. | |
| 5,823,265 | A | 10/1998 | Crow | |
| 5,902,378 | A | 5/1999 | Obrejanu | |
| 6,079,491 | A | 6/2000 | Stuebinger et al. | |
| 6,089,322 | A | 7/2000 | Kelley et al. | |
| 6,092,599 | A | 7/2000 | Berry et al. | |
| 6,092,600 | A | 7/2000 | McKinzie | |
| 6,131,660 | A | 10/2000 | Stuebinger et al. | |
| 6,138,758 | A | 10/2000 | Shaw et al. | |
| 6,148,923 | A | 11/2000 | Casey | |
| 6,155,345 | A | 12/2000 | Lee et al. | |
| 6,179,056 | B1 | 1/2001 | Smith | |
| 6,216,788 | B1 | 4/2001 | Wilson | |
| 6,179,054 | B1 | 10/2001 | Stewart | |
| 6,367,547 | B1 | 4/2002 | Towers et al. | |
| 6,481,499 | B2 | 11/2002 | Lopes | |
| 6,494,258 | B1 | 12/2002 | Weingarten | |
| 6,705,404 | B2 | 3/2004 | Bosley | |
| 6,736,880 | B2 | 5/2004 | Ford et al. | |
| 6,808,020 | B2 | 10/2004 | Garcia | |
| 6,830,108 | B2 | 12/2004 | Rogers, Jr. et al. | |
| 6,932,160 | B2 | 8/2005 | Murray | |
| 6,945,762 | B2 | 9/2005 | Williams | |
| 6,966,366 | B2 | 11/2005 | Rogers, Jr. et al. | |
| 7,080,692 | B1 * | 7/2006 | Kegin | E21B 43/121 166/372 |
| 7,188,670 | B2 | 3/2007 | Amies et al. | |
| 7,337,854 | B2 | 3/2008 | Horn et al. | |
| 7,665,528 | B2 | 2/2010 | Ross et al. | |
| 8,136,600 | B2 | 3/2012 | Fowler | |
| 8,181,706 | B2 | 5/2012 | Tanton | |
| 8,322,434 | B2 | 12/2012 | Fielding | |
| 8,424,611 | B2 | 4/2013 | Smith | |
| 8,475,147 | B2 | 7/2013 | Losinske | |
| 8,893,777 | B1 | 11/2014 | Garrett | |
| 8,950,473 | B2 | 2/2015 | Smith | |
| 8,985,221 | B2 | 3/2015 | Mazzanti | |
| 9,206,676 | B2 | 12/2015 | Quigley et al. | |
| 9,322,251 | B2 | 4/2016 | Mazzanti | |
| 9,470,073 | B2 | 10/2016 | Xiao et al. | |
| 9,518,458 | B2 | 12/2016 | Ellithorp | |
| 9,631,472 | B2 | 4/2017 | Reid et al. | |
| 9,670,758 | B2 | 6/2017 | Wilson | |
| 9,765,608 | B2 | 9/2017 | Sims | |
| 9,915,256 | B2 | 3/2018 | Bebak et al. | |
| 9,970,420 | B2 | 5/2018 | Wang et al. | |
| 10,174,752 | B2 | 1/2019 | Downing | |
| 10,364,658 | B2 | 7/2019 | Michel | |
| 10,920,559 | B2 | 2/2021 | Zahran | |
| 2002/0162662 | A1 | 11/2002 | Passamaneck | |
| 2003/0215337 | A1 | 11/2003 | Lee | |
| 2004/0238179 | A1 | 12/2004 | Murray | |
| 2005/0053503 | A1 | 3/2005 | Gallant | |
| 2005/0194149 | A1 | 9/2005 | Giaconnino | |
| 2005/0199551 | A1 | 9/2005 | Gordon | |
| 2006/0113072 | A1 | 6/2006 | Lee | |
| 2006/0249284 | A1 | 11/2006 | Victor | |
| 2006/0283791 | A1 | 12/2006 | Ross | |
| 2008/0135239 | A1 | 6/2008 | Edwards et al. | |
| 2008/0210429 | A1 | 9/2008 | Mcmillin et al. | |
| 2008/0230230 | A1 * | 9/2008 | Giacomino | E21B 43/121 166/372 |
| 2009/0038788 | A1 | 2/2009 | Farris | |
| 2010/0038071 | A1 | 2/2010 | Scott et al. | |
| 2010/0147514 | A1 | 6/2010 | Swaringin | |
| 2011/0073322 | A1 | 3/2011 | Smith et al. | |
| 2011/0132593 | A1 | 6/2011 | Phloi-montri | |
| 2012/0318524 | A1 | 12/2012 | Lea et al. | |
| 2013/0068455 | A1 | 3/2013 | Brown et al. | |
| 2013/0319661 | A1 | 12/2013 | Xiao et al. | |
| 2015/0233228 | A1 | 8/2015 | Roth et al. | |
| 2015/0240596 | A1 | 8/2015 | Horwell | |
| 2015/0275633 | A1 | 10/2015 | Tolman et al. | |
| 2015/0292307 | A1 | 10/2015 | Best | |
| 2016/0130922 | A1 | 5/2016 | Wilson | |
| 2016/0222773 | A1 | 8/2016 | Sims | |
| 2016/0333681 | A1 | 11/2016 | Mazzanti | |
| 2017/0044883 | A1 | 2/2017 | Wilkinson et al. | |
| 2017/0081952 | A1 | 3/2017 | Osborne et al. | |
| 2017/0096884 | A1 | 4/2017 | Michel | |
| 2017/0218722 | A1 | 8/2017 | Gordon | |
| 2017/0328189 | A1 | 11/2017 | Wang et al. | |
| 2018/0334890 | A1 | 11/2018 | Stadler et al. | |
| 2019/0292892 | A1 | 9/2019 | Zahran | |
| 2020/0141214 | A1 | 5/2020 | Kuykendall | |
| 2020/0386087 | A1 | 12/2020 | Gaglioti | |
| 2021/0032964 | A1 | 2/2021 | Zahran | |
| 2021/0301635 | A1 | 9/2021 | Zahran | |

FOREIGN PATENT DOCUMENTS

| | | |
|---|---|---|
| CN | 201314221 | 9/2009 |
| CN | 203035167 | 7/2013 |
| CN | 203603854 | 5/2014 |
| CN | 205189837 | 4/2016 |
| CN | 109209305 | 1/2019 |
| EP | 2142755 | 3/2016 |
| GB | 2257185 | 1/1993 |
| GB | 2409691 | 2/2007 |
| GB | 2452370 | 3/2009 |
| WO | WO 2015167895 | 11/2015 |
| WO | WO 2016057011 | 4/2016 |

OTHER PUBLICATIONS

Don-nan.com [online], "Gas Separator: Packer-style gas separator," available on or before Apr. 10, 2012, [retrieved on Sep. 7, 2018], retrieved from : URL <https://irp-cdn.multiscreensite.com/4497d96c/files/uploaded/DN%20GS%20PS.pdf>, 1 page.

Harbison Fisher, "Variable Slippage Pump," 2001, [retrieved on Mar. 15, 2021], retrieved from : URL <http://apergycdn.5thring.co.uk/HF_Variable_Slippage_Pump.pdf>, 8 pages.

Lufkin Oilfield Products Group, "2008/2009 General Catalog," 2008-2009, 72 pages.

McCoy and Podio, "Improved Downhole Gas Separators," presented at the Southwestern Petroleum Short Course, Apr. 7-8, 1998, 11 pages.

McCoy et al., "Downhole Gas Separators: A Laboratory and Field Study," presented at the Gas Well De-Liquification Workshop, Feb. 27-Mar. 1, 2006, 47 pages.

Odessaseparator.com [online], "OSI: Fluid Conditioning Systems," available on or before Apr. 7, 2017, via Internet Archive: Wayback Machine URL: <https://web.archive.org/web/20170407235934/http://www.odessaseparator.com/products>, [retrieved on Sep. 7, 2018], retrieved from URL <https://www.odessaseparator.com/products>, 4 pages.

Samayamantula, "An Innovative Design for Downhole Gas Separation," Don-Nan Pump and Supply Company, presented at the Oil and Gas Technology Webinar hosted by IEEE, Engineering 360, May 22, 2013, 16 pages.

(56) References Cited

OTHER PUBLICATIONS

Valbuena et al., "Defining the Artificial Lift System Selection Guidelines for Horizontal Wells," SPE-181229-MS, Society of Petroleum Engineers (SPE), presented at the SPE North American Artificial Lift Conference and Exhibition, Oct. 25-27, 2016, 20 pages.
Xu et al., "Rod Pumping Deviated Wells," Lufkin Automation, 2005, 14 pages.

* cited by examiner

TAPERED MULTISTAGE PLUNGER LIFT WITH BYPASS SLEEVE

TECHNICAL FIELD

This disclosure relates to artificial lift systems and, more particularly, to multistage plunger lift systems.

BACKGROUND

Plunger lift systems are artificial lift systems that can used for oil production in oil wells that have a gas-liquid ratio that poses production difficulties for other artificial lift systems and for deliquification of gas wells. Plunger lift systems use wellbore pressure and plungers to transport wellbore fluids to the surface.

SUMMARY

This disclosure describes a multistage plunger lift tool, method, and system.

Certain aspects of the subject matter herein can be implemented as a multistage plunger lift system. The system includes a lower production tubing segment that is positioned in the wellbore and that has a lower production tubing inner diameter. An upper production tubing segment is positioned in the wellbore uphole of the lower production tubing segment. The upper production tubing segment has an upper production tubing inner diameter greater than the lower production tubing inner diameter. A tapered shoulder segment connects an upper end of the lower production tubing segment with a lower end of the upper production tubing segment. The system further includes a lower traveling plunger configured to travel within the lower production tubing segment and sized to fit within the lower production tubing inner diameter and an upper traveling plunger configured to travel within the upper production tubing segment and sized to fit within the upper production tubing inner diameter. A plunger lift tool is positioned within the upper production tubing segment proximate to the tapered shoulder segment and between the upper traveling plunger and the lower traveling plunger. The plunger lift tool includes a main body that includes a top end and a bottom end, a fluid passageway within the main body, and a one-way valve configured to allow fluid to flow in an uphole direction through the main body. The plunger lift tool also includes a plunger receptacle sleeve at the bottom end. The plunger receptacle sleeve is configured to receive the lower traveling plunger and includes one or more vents configured to allow fluids flowing from the lower production tubing segment to flow around the lower traveling plunger when the lower traveling plunger is received within the plunger receptacle sleeve.

An aspect combinable with any of the other aspects can include the following features. An inner diameter of the plunger receptacle sleeve is the same or substantially the same as the lower production tubing inner diameter.

An aspect combinable with any of the other aspects can include the following features. The plunger receptacle sleeve is tube-shaped.

An aspect combinable with any of the other aspects can include the following features. The plunger lift tool includes a lower bumper spring positioned within the plunger receptacle sleeve and configured to cushion an impact from the lower traveling plunger and an upper bumper spring at the top end and configured to cushion an impact from an upper traveling plunger.

An aspect combinable with any of the other aspects can include the following features. The upper bumper spring has a greater outer diameter than the lower bumper spring.

An aspect combinable with any of the other aspects can include the following features. A seal element around the main body configured to sealingly engage with an inner surface of the upper production tubing segment when the seal element is set.

An aspect combinable with any of the other aspects can include the following features. A bottom edge of the plunger receptacle sleeve is in contact with an inner surface of the tapered shoulder segment.

An aspect combinable with any of the other aspects can include the following features. The vents include slots in a wall of the plunger receptacle sleeve.

Certain aspects of the subject matter herein can be implemented as a plunger lift tool. The plunger lift tool includes a main body having a fluid passageway and a top end and a bottom end and configured to be positioned within an upper production tubing segment within a wellbore. A seal element around an outer surface of the main body is configured to sealingly engage within an inner surface of the upper production tubing segment when the seal element is set. A one-way valve within the main body is configured to allow fluid to flow in one direction through the passageway. The tool further includes a plunger receptacle sleeve at the bottom end. The plunger receptacle sleeve is configured to receive a lower traveling plunger. The lower traveling plunger is sized to travel within a lower production tubing segment having an inner diameter smaller than an inner diameter of the upper production tubing segment. The plunger receptacle sleeve includes one or more vents configured to allow fluids to flow around the lower traveling plunger when the lower traveling plunger is received within the plunger receptacle sleeve.

An aspect combinable with any of the other aspects can include the following features. An inner diameter of the plunger receptacle sleeve is the same or substantially the same as an inner diameter of the lower production tubing segment.

An aspect combinable with any of the other aspects can include the following features. A lower bumper spring is positioned within the plunger receptacle sleeve and is configured to cushion an impact from the lower traveling plunger.

An aspect combinable with any of the other aspects can include the following features. The tool includes an upper bumper spring at the top end and is configured to cushion an impact from an upper traveling plunger.

An aspect combinable with any of the other aspects can include the following features. The upper bumper spring has a greater outer diameter than the lower bumper spring.

An aspect combinable with any of the other aspects can include the following features. The plunger receptacle sleeve is tube-shaped.

An aspect combinable with any of the other aspects can include the following features. The vents are slots in a wall of the plunger receptacle sleeve.

Certain aspects of the subject matter herein can be implemented as a method. The method includes positioning a lower traveling plunger within a lower production tubing segment positioned within a wellbore. The lower production tubing segment has a lower production tubing inner diameter and is positioned downhole of an upper production tubing segment positioned in the wellbore. The upper production tubing segment has an upper production tubing inner diameter greater than the lower production tubing inner diameter.

An upper end of the lower production tubing segment is connected by a tapered shoulder segment with a lower end of the upper production tubing segment. The method also includes positioning a plunger lift tool within the upper production tubing segment and proximate to the tapered shoulder segment. The plunger lift tool includes a main body comprising a top end and a bottom end, a fluid passageway within the main body, a one-way valve configured to allow fluid to flow in an uphole direction through the passageway, a plunger receptacle sleeve at a bottom end. The plunger receptacle sleeve is configured to receive the lower traveling plunger and includes one or more vents configured to allow fluids flowing from the lower production tubing segment to flow around the lower traveling plunger when the lower traveling plunger is received within the plunger receptacle sleeve. The method also includes positioning an upper traveling plunger within the upper production tubing segment and uphole of the plunger lift tool, and cycling, by a selective opening and closing of the well, the lower traveling plunger and the upper traveling plunger up and down within the lower production tubing segment and the upper production tubing segment, respectively, thereby lifting liquids from a bottom portion of the wellbore to an upper portion of the wellbore.

An aspect combinable with any of the other aspects can include the following features. The method also includes producing fluids from the wellbore. A portion of a volume of the fluids produced is attributable to a volume of fluids flowed through the vents when the lower traveling plunger is positioned within the plunger receptacle sleeve as the lower traveling plunger reaches a top position during the cycling.

An aspect combinable with any of the other aspects can include the following features. The method also includes positioning, prior to positioning the lower raveling plunger within the lower production tubing, a bottom hole bumper assembly in the lower production tubing assembly downhole of the lower traveling plunger. The bottom hole bumper assembly is configured to cushion an impact from the lower traveling plunger as the lower traveling plunger reaches a bottom position during the cycling.

An aspect combinable with any of the other aspects can include the following features. An inner diameter of the plunger receptacle sleeve is the same or substantially the same as the lower production tubing inner diameter.

An aspect combinable with any of the other aspects can include the following features. The plunger lift tool also includes a seal element around the main body configured to sealingly engage with an inner surface of the upper production tubing segment when the seal element is set.

An aspect combinable with any of the other aspects can include the following features. The plunger receptacle sleeve is tube-shaped.

An aspect combinable with any of the other aspects can include the following features. A bottom edge of the plunger receptacle sleeve is in contact with an inner surface of the tapered shoulder segment when the plunger lift tool is positioned within the upper production tubing segment.

An aspect combinable with any of the other aspects can include the following features. The vents are slots in the wall of the plunger receptacle sleeve.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1:
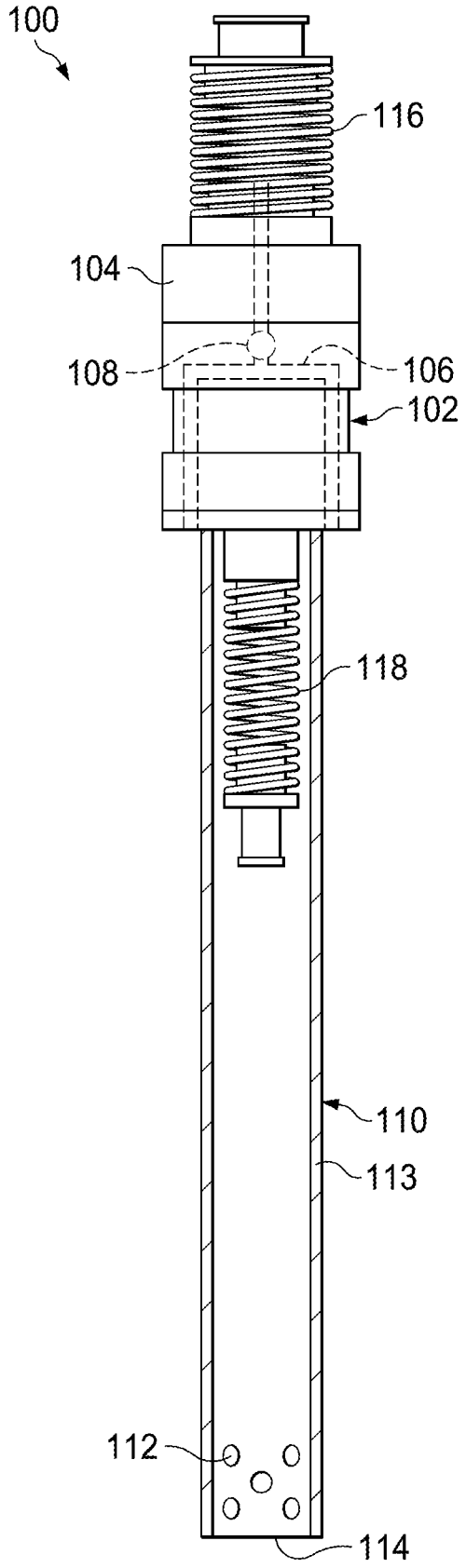
FIG. 1 is a schematic diagram of a multistage plunger lift tool in accordance with an embodiment of the present disclosure.

The present disclosure is directed to apparatuses, systems, and methods of artificial lift systems. Particularly, the present disclosure is directed to a multistage plunger lift tool, method, and system.

Plunger lift is a widely used artificial lift mechanism for high gas liquid ratio (GLR) oil wells and for gas well deliquification. In a plunger lift system, a free piston or plunger is dropped into the production tubing. By selectively opening or closing the surface well valve, plunger lift utilizes the reservoir natural energy to lift the plunger and the accumulated liquids (such as oil or water) up the production tubing.

In a multistage plunger lift system, multiple plungers are used. A multistage lift tool is installed in the production tubing between the plungers. The multistage tool includes main body with a passageway therethrough, and a seal element around the tool and a one-way check valve to allow liquids to flow uphole (from below the tool to above the tool) but to not flow downhole (from above the tool to below the tool). In a multistage plunger lift system with two stages, a lower plunger is installed in the production tubing below the multistage lift tool (before installation of the tool) and an upper plunger is installed in the production tubing above the multistage lift tool (after installation of the tool). A bumper spring may be installed at the bottom of the production tubing, and the multistage lift tool may likewise have bumper springs at its top and bottom ends, to cushion the impact of the plungers.

In operation, the wellbore in a multistage system is shut-in at the surface and the plungers are allowed to fall to their bottom positions due to gravity, a period of the cycle called "fall time." In their bottom positons, the lower plunger sits atop the bottom well bumper spring and the upper plunger sits atop the multistage lift tool. Liquids in the well accumulate above the plungers as they sit in their respective bottom positions. The well is then opened, and well pressure causes both plungers to travel upwards—lifting the accumulated liquids above them—until the lower plunger reaches the multistage tool and upper plunger reaches the surface, during so-called "travel time." As the lower plunger reaches the multistage tool, fluid from above the lower plunger travels through the passageway of the multistage tool and accumulates above the multistage tool (and is prevented from flowing in a downhole direction by the check-valve). Both plungers remain in their uphole positions due to the upwards fluid flow during so-called after-flow, as the lifted liquids from the upper plunger and the other fluids are produced from the well. The well is then shut in and the plungers fall back down due to gravity, and a new cycle begins.

In accordance with an embodiment of the present disclosure, a multistage plunger lift tool includes a plunger receptacle sleeve at its bottom end. The plunger receptacle sleeve can in some embodiments be tube-shaped and is configured to receive the lower traveling plunger as the lower traveling plunger reaches the top position of the cycle. The plunger receptacle sleeve includes one or more vents configured to allow fluids flowing in an uphole direction to flow around the lower traveling plunger when the lower traveling plunger is received within the plunger receptacle sleeve. Combined with a tapered production tubing, the improved lift tool can improve the smoothness and efficiency of the lower plunger's travel by minimizing plunger wobble and other undesirable plunger movement and minimizing friction. Furthermore, because the vents allow fluid to bypass (flow around) the lower traveling plunger during the after flow period (i.e., the plunger does not block the flow), fluid (oil and/or gas) production can be increased. Whereas a standard multistage lift system may produce approximately 40-60 barrels of fluid per day (BFPD), a tapered multistage system utilizing the vented lift tool as described in the present disclosure could produce an estimated 150-200 BFPD.

FIG. 1 is a schematic diagram of a multistage lift tool in accordance with an embodiment of the present disclosure. Referring to FIG. 1, lift tool 100 includes a main body 102 with a seal element 104. Lift tool 100 is configured to be positioned within production tubing. In some embodiments, seal element 104 may be expandable using a setting tool or other device. In some embodiments, lift tool 100 may include locks, latches, or other components to allow lift tool 100 to be selectively set within or removed from the production tubing.

Lift tool 100 includes a fluid passageway 106 within main body 102 to allow fluids to travel upwards through the tool. A one-way check valve 108 allows upward flow but prevents fluids from flowing downwards through the fluid passageway.

Positioned at the bottom end of lift tool 100 is plunger receptacle sleeve 110. Plunger receptacle sleeve 110 is sized and configured to receive a traveling lower plunger (see FIG. 2) and in the illustrated embodiment is a tube-shaped hollow sleeve. Plunger receptacle sleeve 110 includes vents 112 which comprise holes in the wall 113 of plunger receptacle sleeve 110 and are configured to allow fluid to bypass (flow around) the traveling plunger and up through the fluid passageway of the tool when the lower traveling plunger is received within the plunger receptacle sleeve. In some embodiments, vents 112 are positioned proximate to the bottom edge 114 of plunger receptacle sleeve 110 and can comprise narrow slots, circular holes, mesh holes, or other suitable vent shapes or configurations. The number and size of the vents can be chosen so as to provide an adequate flow area to maximize the volume of fluid that can be bypassed around the plunger, based on the expected flow rate from the lower production tubing below the tool (see FIG. 2).

Figure 2:
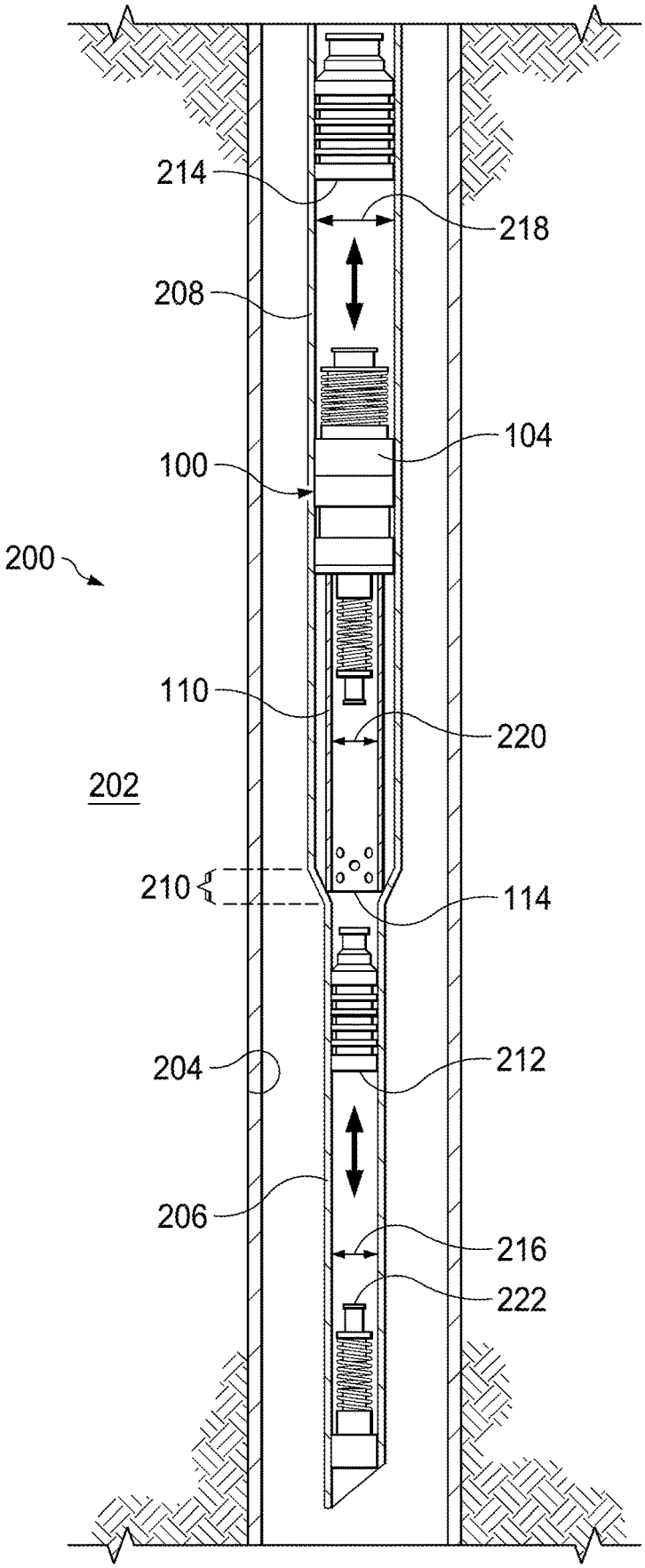
FIG. 2 is a schematic diagram of a multistage plunger lift system in accordance with an embodiment of the present disclosure.

Lift tool 100 also includes an upper bumper spring 116 at its top end and a lower bumper spring 118 at its lower end, configured to cushion the impact of plungers striking lift tool 100 as they cycle up and down (see FIG. 2). Lower bumper spring 118 is positioned within plunger receptacle sleeve 110. As described reference to FIG. 2, lift tool 100 is configured to be used in conjunction with a tapered production tubing system; i.e., a system wherein a lower production tubing segment is of a smaller inner diameter than an upper production tubing segment. In the illustrated embodiment, main body 102 is sized to fit within a larger-diameter upper production tubing segment and upper bumper spring 116 has a size (for example, a diameter) suitable to receive impact from an upper plunger that is in turn sized to fit within that upper production tubing segment. Lower bumper spring 118 would receive impact from a lower plunger that is in turn sized to fit within a lower production tubing segment that has a smaller inner diameter than the upper production tubing segment. Therefore, lower bumper spring 118 has a smaller size (for example, a smaller diameter) than upper bumper spring 116. The inner diameter of plunger receptacle sleeve 110 can in some embodiments be the same (or substantially the same) as the inner diameter of the lower production tubing segment.

FIG. 2 is a schematic illustration of a multistage plunger lift system 200 in accordance with an embodiment of the present disclosure. Referring to FIG. 2, system 200 includes a wellbore 204 drilled into a subterranean zone 202. In some embodiments, wellbore 204 can be cased, in other embodiments, wellbore 204 can be uncased or open-hole. Production tubing is positioned within wellbore 204. Specifically, a lower production tubing segment 206 is positioned within wellbore 204, and an upper production tubing segment 208 is positioned in wellbore 204 uphole of lower production tubing segment 206. In the illustrated embodiment, the inner diameter 216 of lower production tubing segment 206 is smaller than the inner diameter 218 of upper production tubing segment 208. A tapered (or shoulder) production tubing segment 210 connects the upper end of lower production tubing segment 206 with the lower end of upper production tubing segment 208. In some embodiments, upper production tubing segment 208 can be a 3½ inch tubing and lower production tubing segment 206 can be a 2⅞ inch tubing. In other embodiments, upper production tubing segment 208 can be a 2⅞ inch tubing and lower production tubing segment 206 can be a 2⅜ inch tubing. In other embodiments, upper production tubing segment 208 can be a 2⅜ inch tubing and lower production tubing segment 206 can be a 1.9 inch tubing. The length of lower production tubing segment 206 can be chosen based on the gas-liquid ratio of the well and the required liquid handling capacity. In some embodiments, lower production tubing segment 206 can have a length of about 40% to 60% of the total well depth.

A lower plunger 212 can be dropped into wellbore 204 and into lower production tubing segment 206. Lower plunger 212 is sized to fit the inner diameter 216 of lower production tubing segment 206. In the illustrated embodiment, bottom bumper spring 222 is positioned at the bottom of lower production tubing segment 206 and is configured to cushion an impact from lower plunger 212.

A multistage lift tool can be positioned in the wellbore 204, within upper production tubing segment 208, proximate to tapered segment 210. In the illustrated embodiment, the lift tool is lift tool 100 as described in reference to FIG. 1. In the illustrated embodiment, the lower edge 114 of plunger receptacle sleeve 110 of lift tool 100 rests on (or is positioned upon) an inner surface of tapered segment 210. In the illustrated embodiment, plunger receptacle sleeve 110 is sized such that its inner diameter 220 is the same (or substantially the same) as the inner diameter 216 of lower production tubing segment 206, and thus is sized and configured to receive lower plunger 212 within its inner volume.

In the illustrated embodiment, seal element 104 is expanded to seal the space between the outer surface of lift tool 100 and the inner surface of upper production tubing segment 208 and lift tool 100 can be locked into place with a latch (not shown) or similar device to prevent vertical movement. After lift tool 100 is set into place, an upper plunger 214 can be dropped into wellbore 204. Upper plunger 214 is sized to fit the inner diameter 218 of upper production tubing segment 208.

Lower plunger 212 and upper plunger 214 can in some embodiments comprise solid plungers. In some embodiments, lower plunger 212 and/or upper plunger 214 can include a one-way check valve to increase the rate of travel as the plungers fall due to gravity in the downhole direction.

In operation, liquids accumulate above lower plunger 212 and upper plunger 214 as they sit atop the bottom well bumper spring 222 and upper bumper spring 116, respectively. The well is then opened, and well pressure causes both plungers to travel upwards—lifting the accumulated liquids above them—until lower plunger 212 reaches lower bumper spring 118 within plunger receptacle sleeve 110 and upper plunger 212 reaches the surface. As the lower plunger 212 reaches lift tool 100, fluid from above lower plunger 212 travels through passageway 106 accumulates above lift tool 100 (and is prevented from flowing in a downhole direction by check-valve 108). Both plungers remain in their uphole positions due to the upwards pressure of fluid flow during the after-flow period, as the lifted liquids from the upper plunger and the other fluids are produced from the well. The well is then shut-in and plungers 212 and 214 fall back down due to gravity, and a new cycle begins.

Because the inner diameter of plunger receptacle sleeve 110 is the same (or substantially the same) as the inner diameter of lower production tubing segment 206, plunger receptacle sleeve 110 minimizes plunger wobble (or other undesirable plunger movement) and friction as plunger 212 cycles up and down near the top portion of its travel cycle (i.e., as plunger 212 exits out of the top end of lower production tubing segment 206 and strikes against lower bumper spring 118 of lift tool 100, remaining within plunger receptacle sleeve 110 during the after-flow period, and then falling down again during fall time). In this way, smoothness and operational efficiency of the multistage plunger cycling of system 200 is optimized. In some embodiments, the inner diameter of plunger receptacle sleeve 110 is no smaller than the drift diameter of lower production tubing segment 206 and no larger than the nominal inner diameter of lower production tubing segment 206, as per the tubing manufacturer's specifications.

Figure 3:
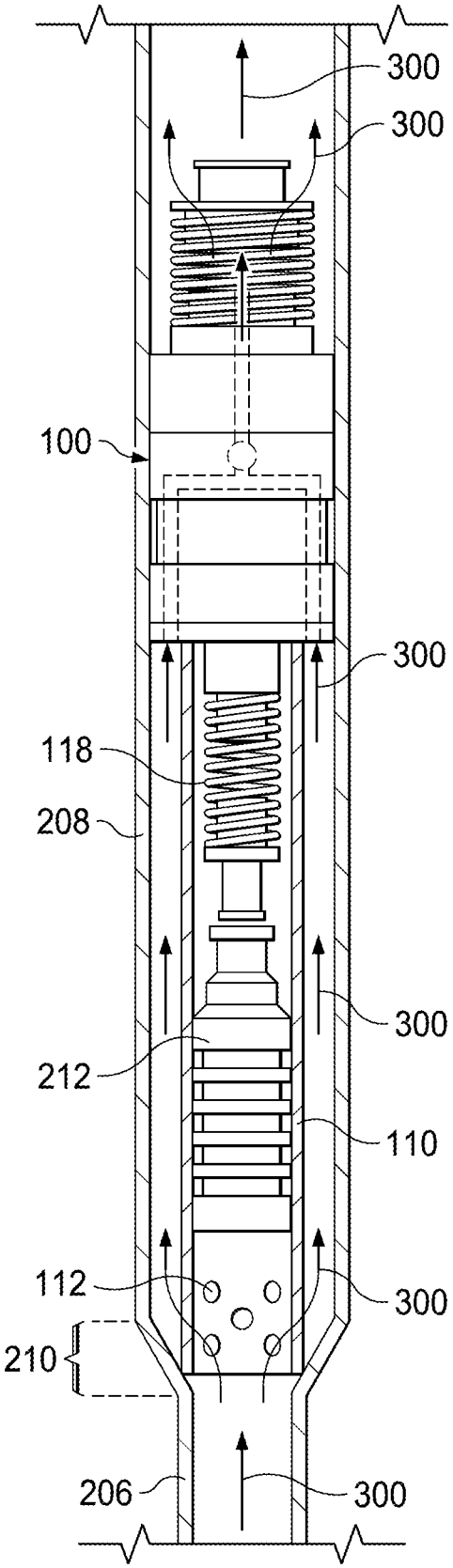
FIG. 3 is a schematic diagram of a multistage plunger lift tool in accordance with an embodiment of the present disclosure, with a traveling plunger received within a plunger receptacle slotted bypass sleeve of the lift tool during the after-flow period of the lift cycle.

FIG. 3 is a schematic illustration of the system of FIG. 2 with lower plunger 212 received within plunger receptacle sleeve 110 of lift tool 100 during the after-flow period of the lift cycle. As described above, lift tool 100 is positioned within upper production tubing segment 208 and rests on (or is positioned on) shoulder segment 210. As lower plunger 212 is received within plunger receptacle sleeve 110 and remains there during the after-flow period, it is positioned above vents 112. With lower plunger 212 so positioned during the after-flow period (until the force of the well pressure is overcome by the force of gravity, either because of the gradual depletion of pressure or because the well is shut in), fluids 300 flowing in an uphole direction from lower production tubing segment 206 can flow through vents 112, around lower plunger 212 and up through passageway 106, and lower plunger 212 does not block the flow of fluids 300. Thus, production of fluids 300 is maximized during the after-flow period of the cycling of the multistage plunger system.

Figure 4:
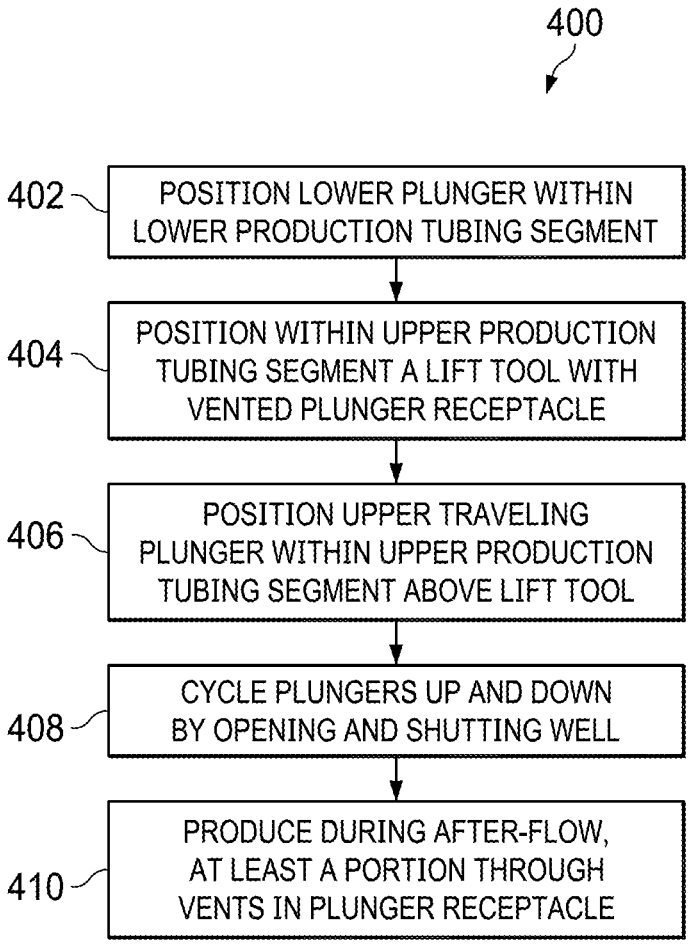
FIG. 4 is a process flow diagram of a method for multistage plunger lift method in accordance with an embodiment of the present disclosure.

FIG. 4 is a process flow diagram of a method of multistage plunger lift method in accordance with an embodiment of the present disclosure. Method 400 of FIG. 4 will be described with reference to the lifting tool 100 and system 200 described in reference to FIG. 1, FIG. 2, and FIG. 3. Referring to FIG. 4, method 400 begins at step 402 wherein lower plunger 212 is dropped into wellbore 204 to fall into lower production tubing segment 206.

At step 404, a lift tool such as lift tool 100 is positioned within upper production tubing segment 208, proximate to shoulder segment 210 that connects upper production tubing segment 208 with lower production tubing segment 206. As described above with reference to FIG. 1, lift tool 100 includes a main body 102 and a fluid passageway 106 within main body 102, and a check-valve (one-way valve) 108 configured to allow fluid to flow in an uphole direction through passageway 106. Lift tool 100 also includes a plunger receptacle sleeve 110 at its bottom end. In an embodiment of the present disclosure, plunger receptacle sleeve 110 has a tube-shaped body and is sized to receive the lower plunger 212. Plunger receptacle sleeve 110 includes one or more vents 112 configured to allow fluids flowing from lower production tubing segment 206 to bypass (flow around) lower plunger 212 when the lower traveling plunger is received within plunger receptacle sleeve 110.

At step 406, an upper plunger 214 is positioned within upper production tubing segment 208, above lift tool 100. At step 408, the lift cycle is commenced, such that the plungers 212 and 214 travel up (due to well pressure) and down (due to gravity), repeatedly from selective opening and closing of the well (i.e., of a valve at the top of wellbore 204), thereby lifting liquids from a bottom portion of wellbore 204 to an upper portion of wellbore 204.

At step 410, during the after-flow portion of the cycles, fluids such as oil and/or gas are produced from wellbore 204, and at least of portion of the volume of that production is attributable to a volume of fluids flowed through vents 112 when the lower plunger 212 is positioned within plunger receptacle sleeve 110 as the lower plunger 212 reaches a top position during the cycling. Fluids may be produced from wellbore 204 during other portions of the cycling as well.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A multistage plunger lift system, comprising:

a lower production tubing segment positioned in the wellbore and having a lower production tubing inner diameter;

an upper production tubing segment positioned in the wellbore uphole of the lower production tubing segment and having an upper production tubing inner diameter greater than the lower production tubing inner diameter;

a tapered shoulder segment connecting an upper end of the lower production tubing segment with a lower end of the upper production tubing segment;

a lower traveling plunger configured to travel within the lower production tubing segment and sized to fit within the lower production tubing inner diameter;

an upper traveling plunger configured to travel within the upper production tubing segment and sized to fit within the upper production tubing inner diameter; and a plunger lift tool positioned within the upper production tubing segment proximate to the tapered shoulder segment and between the upper traveling plunger and the lower traveling plunger, the plunger lift tool comprising:

a main body comprising a top end and a bottom end;

a fluid passageway within the main body; a one-way valve configured to allow fluid to flow in an uphole direction through the main body; and a plunger receptacle sleeve at the bottom end, the plunger receptacle sleeve configured to receive the lower traveling plunger and comprising one or more vents configured to allow fluids flowing from the lower production tubing segment to flow around the lower traveling plunger when the lower traveling plunger is received within the plunger receptacle sleeve.

2. The multistage plunger lift system of claim 1, wherein an inner diameter of the plunger receptacle sleeve is the same or substantially the same as the lower production tubing inner diameter.

3. The multistage plunger lift system of claim 1, wherein the plunger receptacle sleeve is tube-shaped.

4. The multistage plunger lift system of claim 1, wherein the plunger lift tool further comprises a lower bumper spring positioned within the plunger receptacle sleeve and configured to cushion an impact from the lower traveling plunger and an upper bumper spring at the top end and configured to cushion an impact from the upper traveling plunger.

5. The multistage plunger lift system of claim 4, wherein the upper bumper spring has a greater outer diameter than the lower bumper spring.

6. The multistage plunger lift system of claim 1, further comprising a seal element around the main body configured to sealingly engage with an inner surface of the upper production tubing segment when the seal element is set.

7. The multistage plunger lift system of claim 1, wherein a bottom edge of the plunger receptacle sleeve is in contact with an inner surface of the tapered shoulder segment.

8. The multistage plunger lift system of claim 1, wherein the vents comprise slots in a wall of the plunger receptacle sleeve.

9. A plunger lift tool comprising:

a main body having a top end and a bottom end and configured to be positioned within an upper production tubing segment within a wellbore, the main body comprising a fluid passageway;

seal element around an outer surface of the main body configured to sealingly engage within an inner surface of the upper production tubing segment when the seal element is set;

a one-way valve within the main body and configured to allow fluid to flow in one direction through the fluid passageway;

a plunger receptacle sleeve at the bottom end, the plunger receptacle sleeve configured to receive a lower traveling plunger, wherein the lower traveling plunger is sized to travel within a lower production tubing segment having an inner diameter smaller than an inner diameter of the upper production tubing segment, and wherein the plunger receptacle sleeve comprises one or more vents configured to allow fluids to flow around the lower traveling plunger when the lower traveling plunger is received within the plunger receptacle sleeve.

10. The plunger lift tool of claim 9, wherein an inner diameter of the plunger receptacle sleeve is the same or substantially the same as an inner diameter of the lower production tubing segment.

11. The plunger lift tool of claim 9, further comprising a lower bumper spring positioned within the plunger receptacle sleeve and configured to cushion an impact from the lower traveling plunger.

12. The plunger lift tool of claim 11, further comprising an upper bumper spring at the top end and configured to cushion an impact from an upper traveling plunger.

13. The plunger lift tool of claim 12, wherein the upper bumper spring has a greater outer diameter than the lower bumper spring.

14. The plunger lift tool of claim 9, wherein the plunger receptacle sleeve is tube-shaped.

15. The plunger lift tool of claim 9, wherein the vents comprise slots in a wall of the plunger receptacle sleeve.

16. A method comprising:

positioning a lower traveling plunger within a lower production tubing segment positioned within a wellbore, the lower production tubing segment having a lower production tubing inner diameter and positioned downhole of an upper production tubing segment positioned in the wellbore, the upper production tubing segment having an upper production tubing inner diameter greater than the lower production tubing inner diameter, an upper end of the lower production tubing segment connected by a tapered shoulder segment with a lower end of the upper production tubing segment;

positioning, within the upper production tubing segment and proximate to the tapered shoulder segment, a plunger lift tool, the plunger lift tool comprising:

a main body comprising a top end and a bottom end;

a fluid passageway within the main body;

a one-way valve configured to allow fluid to flow in an uphole direction through the passageway; and a plunger receptacle sleeve at a bottom end, the plunger receptacle sleeve configured to receive the lower traveling plunger and comprising one or more vents configured to allow fluids flowing from the lower production tubing segment to flow around the lower traveling plunger when the lower traveling plunger is received within the plunger receptacle sleeve;

positioning, within the upper production tubing segment and uphole of the plunger lift tool, an upper traveling plunger;

cycling, by a selective opening and closing of the well, the lower traveling plunger and the upper traveling plunger up and down within the lower production tubing segment and the upper production tubing segment, respectively, thereby lifting liquids from a bottom portion of the wellbore to an upper portion of the wellbore.

17. The method of claim 16, further comprising producing fluids from the wellbore, wherein a portion of a volume of the fluids produced is attributable to a volume of fluids flowed through the vents when the lower traveling plunger is positioned within the plunger receptacle sleeve as the lower traveling plunger reaches a top position during the cycling.

18. The method of claim 16, further comprising positioning, prior to positioning the lower raveling plunger within the lower production tubing, a bottom hole bumper assembly in the lower production tubing assembly downhole of the lower traveling plunger, the bottom hole bumper assembly configured to cushion an impact from the lower traveling plunger as the lower traveling plunger reaches a bottom position during the cycling.

19. The method of claim 16, wherein an inner diameter of the plunger receptacle sleeve is the same or substantially the same as the lower production tubing inner diameter.

20. The method of claim 16, the plunger lift tool further comprises a seal element around the main body configured to sealingly engage with an inner surface of the upper production tubing segment when the seal element is set.

21. The method of claim 16, wherein the plunger receptacle sleeve is tube-shaped.

22. The method of claim 16, wherein a bottom edge of the plunger receptacle sleeve is in contact with an inner surface of the tapered shoulder segment when the plunger lift tool is positioned within the upper production tubing segment.

23. The method of claim 16, wherein the vents comprise slots in a wall of the plunger receptacle sleeve.

* * * * *